US006676454B2

(12) United States Patent
De France

(10) Patent No.: US 6,676,454 B2
(45) Date of Patent: Jan. 13, 2004

(54) TOP-LOADING PAD MOUNT CONNECTOR

(75) Inventor: Robert De France, Poughkeepsie, NY (US)

(73) Assignee: Delri LLC, Winsted, CT (US)

( * ) Notice: Subject to any disclaimer, the term of this patent is extended or adjusted under 35 U.S.C. 154(b) by 0 days.

(21) Appl. No.: 10/140,456

(22) Filed: May 7, 2002

(65) Prior Publication Data

US 2003/0211786 A1 Nov. 13, 2003

(51) Int. Cl.[7] ..... H01R 4/40

(52) U.S. Cl. ..... 439/806; 439/797; 439/807; 439/781

(58) Field of Search ..... 439/781, 797, 439/796, 798, 807, 814, 811, 812, 801, 521, 467, 806, 793

(56) References Cited

U.S. PATENT DOCUMENTS 3,144,506 A * 8/1964 Gunthel, Jr. ..... 174/71 R
3,426,319 A * 2/1969 Downs et al. ..... 439/798
4,201,433 A * 5/1980 Caldwell ..... 439/98
5,741,073 A * 4/1998 Ribeiro et al. ..... 374/182
6,347,967 B1 * 2/2002 Tamm ..... 439/806

FOREIGN PATENT DOCUMENTS

FR 2613540 A1 * 10/1988

* cited by examiner

*Primary Examiner*—Tho D. Ta
(74) *Attorney, Agent, or Firm*—Alix, Yale & Ristas, LLP

(57) ABSTRACT

A top-loading pad mount electrical connector is provided with swing-away pressure pads for securing secondary conductors to the connector body. The swing-away pressure pads are frictionally engaged with threaded fasteners to pivot with the fastener between a clamping position where a jaw is aligned with and over a conductor lay-in groove and an open position which clears a conductor lay-in opening above the lay-in groove. A split insulating cover permits the top-loading pad mount connector to be installed and the connections with secondary conductors established prior to electrically insulating the assembly to ensure code compliance.

22 Claims, 6 Drawing Sheets

TOP-LOADING PAD MOUNT CONNECTOR

BACKGROUND OF THE INVENTION

1. Field of the Invention

This invention pertains to multi-tap pad mount connectors that receive a primary electrical connection from a pad-mounted transformer and distribute that electrical connection to a plurality of secondary electrical conductors. More particularly, the invention relates to improvements in the electrical and mechanical connection between a multi-tap pad mount connector and the secondary connectors.

2. Description of the Related Art

In the prior art, it is known to provide a pad mounted transformer enclosure for surrounding a transformer and distributing the electrical output of the secondary side of the transformer to a plurality of secondary lines. Many of the connectors used to establish electrical continuity between the secondary side of a transformer and a plurality of secondary lines require that the ends of the secondary lines be pushed longitudinally through openings. Such insertion can be difficult if the secondary lines are frayed or have burrs. Further, the secondary lines are typically very heavy gauge aluminum or copper wires that are stiff and difficult to maneuver in the limited space of the pad mount transformer enclosure.

U.S. Pat. No. 6,203,384 discloses a multi-tap pad mount connector having multiple secondary conductor lay-in channels. Each conductor lay-in channel is provided with an adjacent obliquely angled flange. A threaded male member (a set screw) penetrates through the flange into the lay-in channel to fix a secondary conductor within the lay-in channel. One drawback of this arrangement is that the set screw tends to have a convex end where it secures the secondary conductor. The secondary conductor also has a convex shape. The two convex shapes of the set screw end and the secondary conductor form a relatively weak and insecure mechanical connection. The clamped portion of the secondary conductor tends to deform in a manner that resists secure clamping by the set screw.

Relevant electrical and building codes require that all conductive surfaces on the connector and secondary conductors be electrically insulated, even though these components are inside the pad mount transformer enclosure. In the prior art, this has been accomplished by enclosing each pad mount connector in a plastic sleeve and then inserting secondary conductors through openings in the plastic sleeve to engage the secondary electrical terminals on the connector. Working through relatively small openings in the plastic sleeve has proven awkward and time consuming. Further, the sleeve makes it difficult to assess the integrity of a connection established within the insulating sleeve by visual inspection.

SUMMARY OF THE INVENTION

A top-loading pad mount connector in accordance with the present invention includes a plurality of conductor lay-in grooves formed transversely to the length of a conductive connector body. A pivoting pressure pad is associated with each conductor lay-in groove. Each pressure pad includes a bore for receiving a fastener that passes through the pressure pad to threadably engage the connector body. A pressure pad guide surface formed on the connector body extends parallel to each fastener.

An outside surface of the pressure pad takes the form of a radius partially surrounding, and substantially parallel to the fastener-receiving bore. The pressure pad rotates between a clamping position in which a laterally projecting jaw projects over the conductor lay-in groove and an open position that uncovers the groove to permit lay-in installation of secondary conductors. Means are provided for transmitting some of the torque applied to the fastener to the pressure pad. The radiused surface of the pressure pad is configured so that tightening of the fastener moves the pressure pad toward the clamping position beyond which it is restrained from pivoting by the pressure pad guide surface. Loosening the fastener moves the pressure pad toward the open position beyond which rotation of the pressure pad is restricted by the pressure pad guide surface.

Another exemplary feature of the present invention is that the threaded bores in the connector body and the associated pressure pad guide surfaces may be angled relative to the connector body longitudinal axis. This angle serves to orient the fastener heads outwardly relative to the pad-mounted transformer and its enclosure. The outwardly oriented fastener heads are more easily accessed by electricians during installation of the secondary lines.

The jaw of the pressure pad includes a concave clamping surface which, when the pressure pad is in the clamping position, is generally aligned with and above the conductor lay-in groove. When the pressure pad is in the open position, the clamping surface is substantially perpendicular to the conductor lay-in groove and positioned out of the way to permit lay-in installation of a secondary conductor. An angled fastener and pressure pad provide a wedge-shaped conductor lay in path that facilitates laying in of the secondary conductors when the pressure pad is in the "open" position.

It will be appreciated by those of skill in the art that the self-aligning properties of a pressure pad in accordance with the present invention permit one hand to both align and secure the pressure pad while the other hand holds a secondary conductor in the lay-in groove. Burred, frayed or otherwise misshapen secondary conductors are guided into place by adjacent surfaces and compressed between the concave lay-in groove and clamping surface of the pressure pad. The opposed concave surfaces of the lay-in groove and jaw clamping surface provide a very strong mechanical engagement between the connector body and the received secondary conductor.

An electrical connector in accordance with the present invention also includes a clamshell insulating cover. The clamshell cover configuration allows the connections with secondary conductors to be established and inspected prior to covering the assembly. A two-part snap-together cover may also be used.

An object of the present invention is to provide a new and improved top-loading pad mount connector that permits lay-in installation of secondary conductors.

Another object of the present invention is to provide a new and improved top-loading pad mount connector to which secondary conductors may be affixed and the connections inspected prior to installation of an insulating cover.

A further object of the present invention is to provide a new and improved top-loading pad mount connector in which the secondary conductor connections have improved electrical and mechanical integrity.

These and other objects, features and advantages of the invention will become readily apparent to those skilled in the art upon reading the description of the preferred embodiments in conjunction with the accompanying drawings.

DETAILED DESCRIPTION OF THE PREFERRED EMBODIMENT

Figure 1:
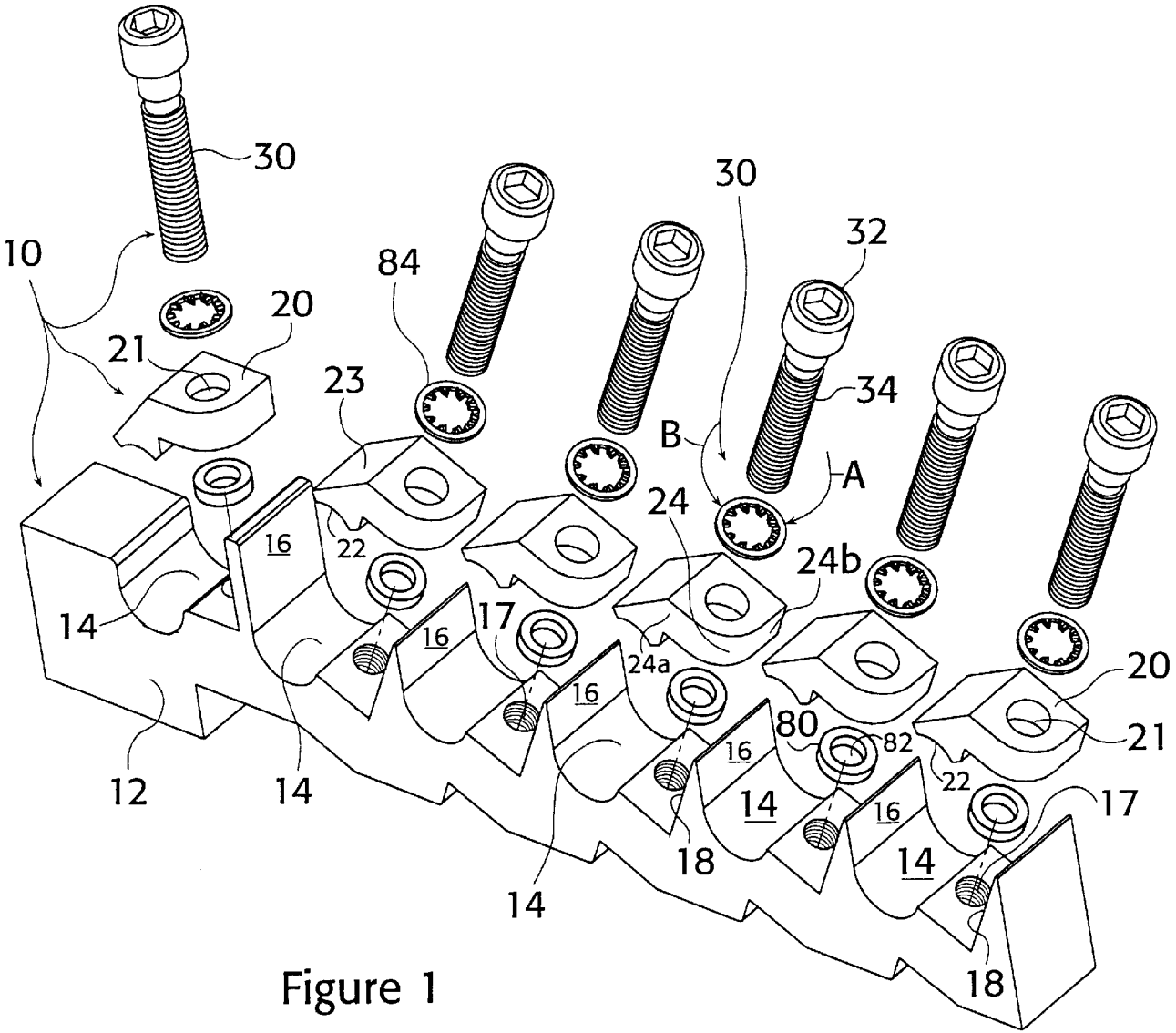
FIG. 1 is a side perspective view of a top-loading pad mount connector in accordance with the present invention.

Referring now to the drawings, which illustrate a preferred embodiment of the invention, a top-loading pad mount connector is generally designated by the numeral 10. The top-loading pad mount connector 10 comprises a longitudinally extending body 12 that defines a plurality of transverse conductor lay-in grooves 14. A swing away pressure pad 20 is provided for each conductor lay-in groove 14. The pressure pads 20 are secured to the connector body 12 by threaded fasteners 30 which pass through an unthreaded fastener bore 21 in the pressure pad to engage a threaded bore 17 in the connector body 12.

Figure 7:
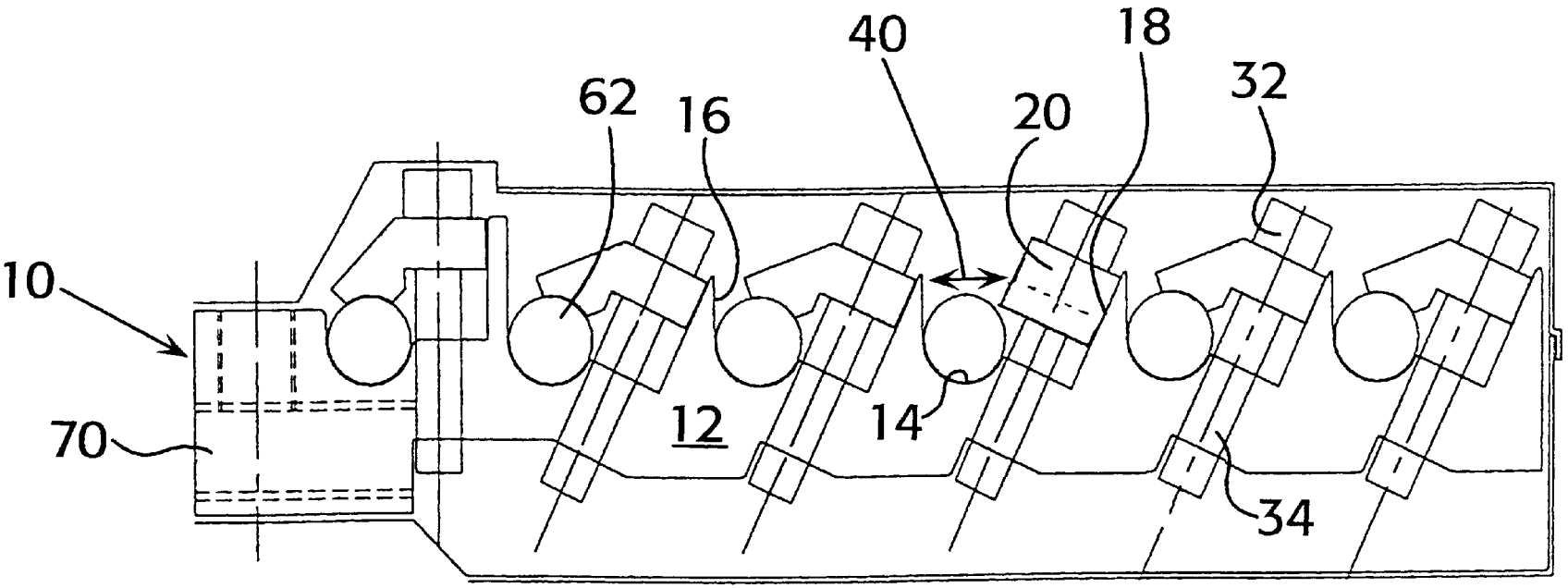
FIG. 7 is a side sectional view, partly in phantom, through a top-loading pad mount connector and clamshell insulating cover assembly in accordance with the present invention.

The body defines a pressure pad guide surface 18 parallel to threaded bore 17. The pressure pad guide surface 18 controls motion of the pressure pad 20 during tightening and loosening of the fastener 30 as will be further discussed below. Because the secondary conductors 62 are generally cylindrical (as best seen in FIG. 7), each conductor lay-in groove is formed as a generally U-shaped groove 14 extending across the width of the connector body 12. Each pressure pad 20 includes a jaw 23 that defines a generally concave clamping surface 22. The concave conductor lay-in groove 14 and pressure pad clamping surface 22 are configured to substantially surround and compress a secondary conductor 62 to securely engage the secondary conductor to the connector body 12.

The illustrated top-loading pad mount connector 10 is suitable for receiving and clamping a range of secondary conductor diameters from #4 AWG (approximately ¼") to 350 MCM (approximately 11/16"). This range is sufficient for the majority of applications. Differently configured lay in grooves and pressure pads may be utilized to shift the range of acceptable secondary wire diameters upwardly or downwardly without departing from the scope of the present invention.

Figure 2:
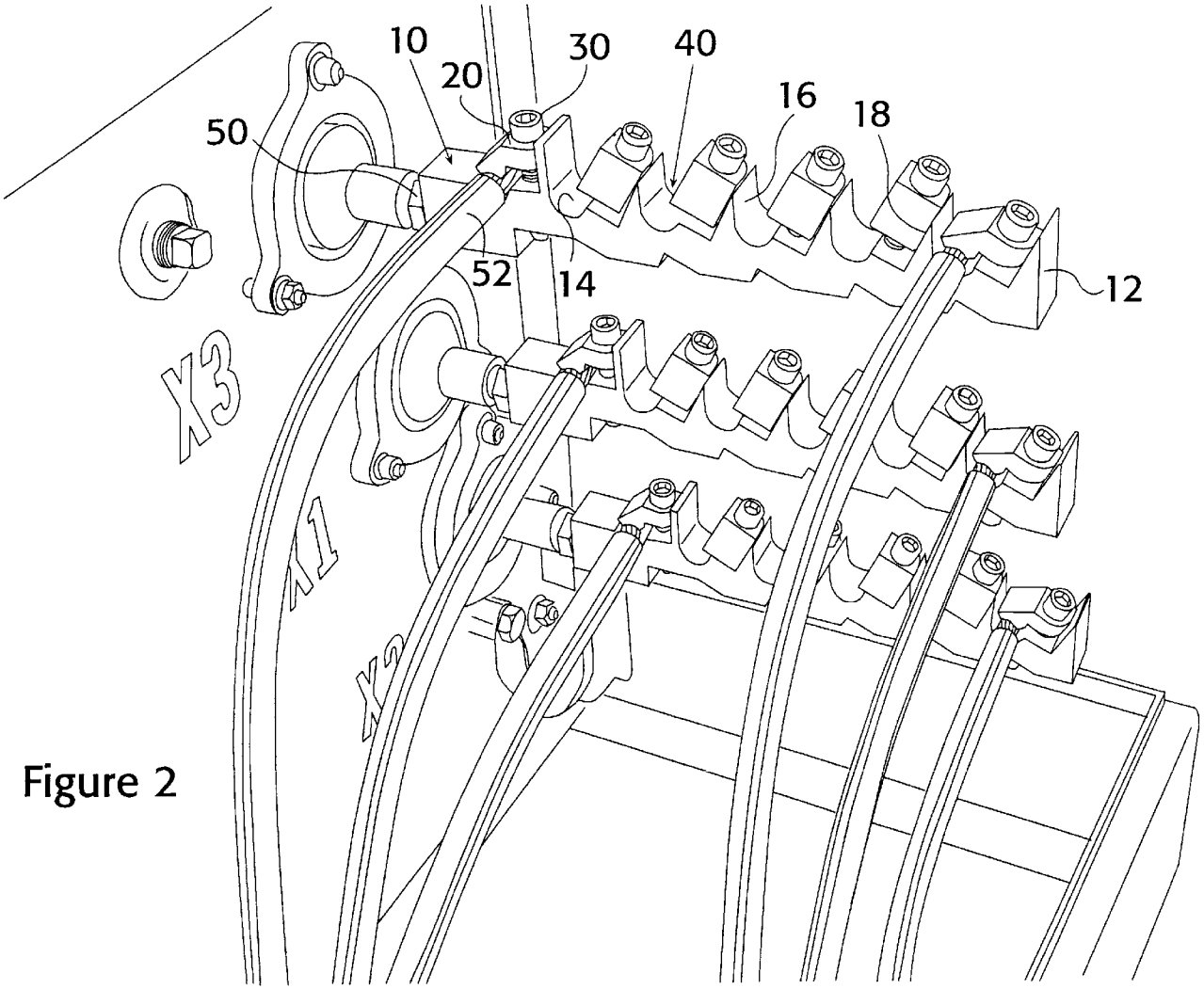
FIG. 2 illustrates three top-loading pad mount connectors of FIG. 1 installed in a pad mount transformer enclosure.
Figure 3:
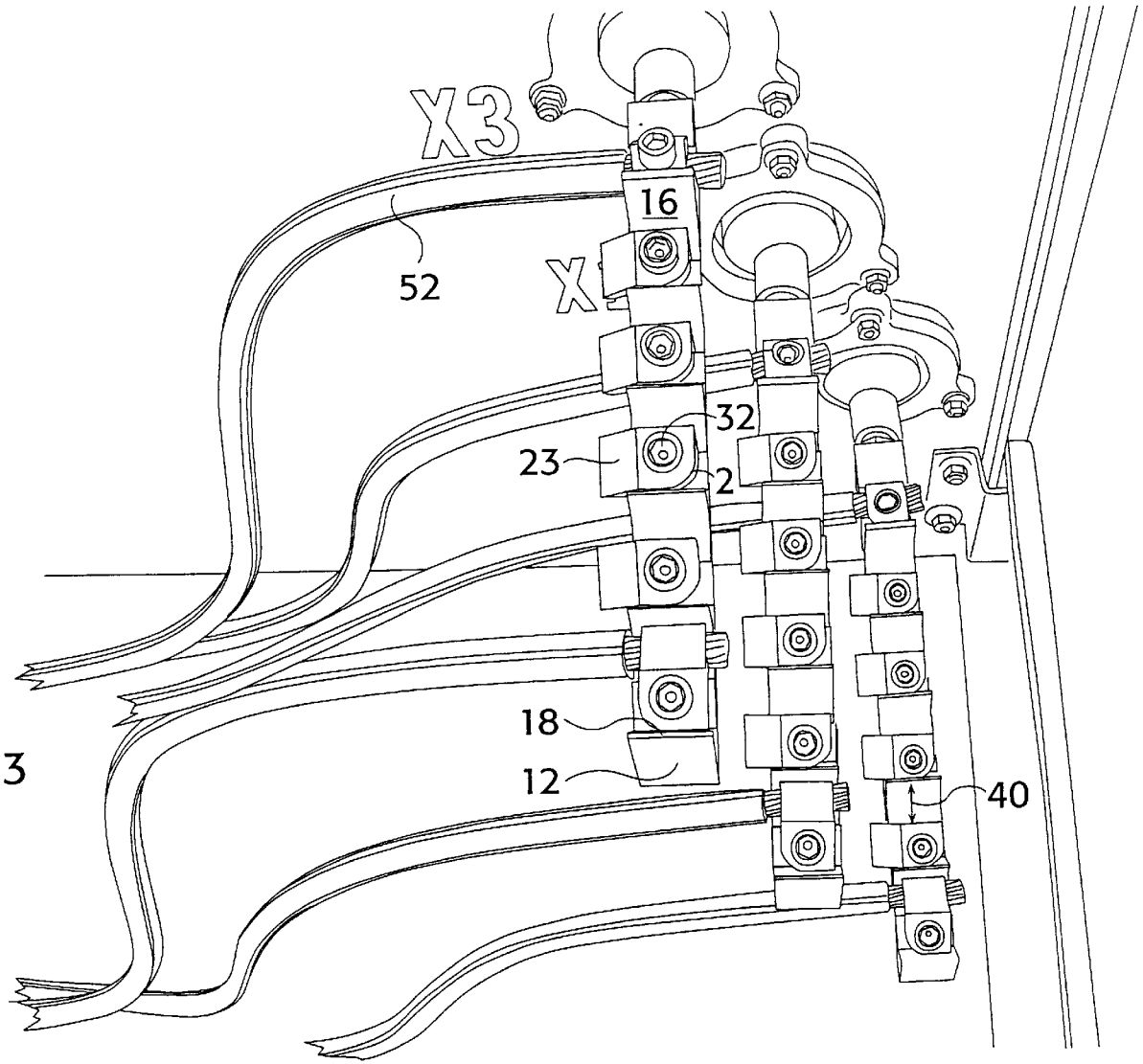
FIG. 3 is an overhead view of the pad mount connectors and enclosure shown in FIG. 2.
Figure 4:
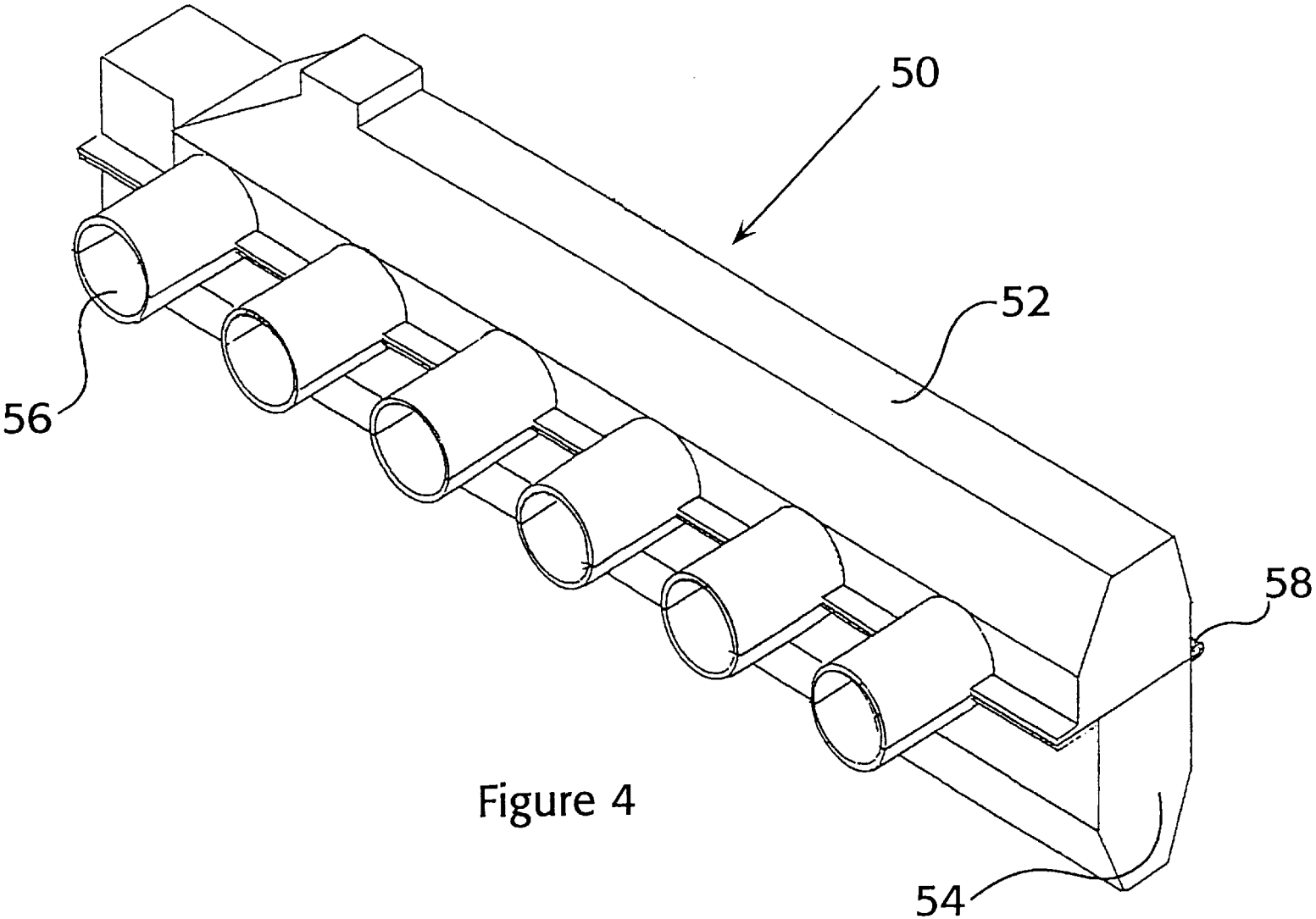
FIG. 4 is a side perspective view of a clamshell insulating cover appropriate for use in conjunction with the top-loading pad mount connector of FIG. 1.

With reference to FIG. 7, the connector body 12 defines a partially threaded blind bore 70 for reception of an electrical connection 60 from a pad mounted transformer secondary winding. Once mounted to the transformer electrical connection 60, as illustrated in FIGS. 2 and 3, the connector body 12 projects away from the transformer (not shown) into the pad mount transformer enclosure.

In the illustrated embodiment 10, guide walls projecting from the connector body 12 separate the conductor lay-in grooves 14. Each guide wall comprises a conductor guide surface 16 axially opposite the pressure pad guide surface 18. The conductor guide surface 16 serves as an aid in inserting a secondary conductor 62 through a lay-in path 40. The lay-in path 40 is available when the pressure pad 20 is pivoted to an open position where the laterally projecting jaw 23 is transverse to the conductor lay-in groove 14. The conductor lay-in path 40 is best seen in FIG. 3 (from above). The conductor lay-in path 40 permits easy installation of a secondary conductor 62 from above by merely laying the conductor into an available conductor lay-in groove 14.

An exemplary feature of the illustrated embodiment is that some of the threaded bores 17 in the conductor body and the associated pressure pad guide surfaces 18 are arranged at an oblique angle relative to the longitudinal axis of the connector body 12. This angled relationship serves two functions. First, the heads 32 of the angled fasteners 30 are oriented outwardly relative to the pad mounted transformer enclosure to enhance the ergonomics of engaging a tightening tool with the head 32 during installation of a secondary conductor. Further, the angled relationship orients the associated pressure pad 20 such that, when the pressure pad is in the open position, the conductor lay in path 40 above the lay-in groove is wedge-shaped, as best seen in FIG. 2. The conductor guide wall 16 and side surface of the pressure pad 20 guide the laying-in of a secondary conductor.

With reference to FIG. 1, a rubber washer 80 with an aperture 82 configured to grasp the threaded shank 34 of fastener 30 is installed between the pressure pad 20 and the connector body 12. The rubber washer is configured to transmit a portion of the torque applied at the head 32 of fastener 30 to the pressure pad 20 by engaging the threaded shank 34 of the fastener to hold the pressure pad 20 against the screw head 32. Torque transmitted from the fastener 30 to the pressure pad 20 by the rubber washer 80 pivots the pressure pad between a clamping position (shown in FIG. 1) where the clamping surface 22 projects over and is generally aligned with a conductor lay-in groove 14 and an open position (illustrated in FIGS. 2, 3 and 7) where the clamping surface 22 is generally perpendicular to the conductor lay-in groove 14.

A lock washer 84 is provided between the screw head 32 and the pressure pad 20. The lock washer 84 enhances the integrity of the assembled connector 10 by preventing rotation of the fastener in direction B (loosening) after assembly.

In accordance with one aspect of the present invention, each pressure pad 20 is provided with a curved surface 24 generally parallel to the fastener bore 21. The curved surface 24 interacts with the pressure pad guide surface 18 to allow the pressure pad to rotate over an arc of 90° between the above-described clamping and open positions. The rubber washer 80 transmits a portion of the torque applied to the fastener 30 when tightening the fastener in direction A to move the pressure pad toward the clamping position as seen in FIG. 1. Loosening the fastener 30 by rotating it in direction B causes the pressure pad 20 to pivot away from the clamping position and toward the open position illustrated in FIGS. 2, 3 and 7. Rotation of the pressure pad in direction A beyond the clamping position is restricted by the pressure pad guide surface 18 contacting curved surface portion 24*b*. Rotation of the pressure pad 20 in direction B beyond the open position is limited by the pressure pad guide surface 18 contacting curved surface portion 24*a*.

It will be understood by those of skill in the art that frictional engagement of the pressure pad with the fastener 30, providing each pressure pad with a curved surface 24 and the adjacent pressure guide surface 18 provide a self-aligning pressure pad 20. Tightening the pressure pad fastener 30 automatically places the pressure pad in its clamping position aligned over a conductor lay-in groove 14 and received conductor 62. Loosening the pressure pad fastener 30 automatically pivots or rotates the pressure pad 20 to its open position uncovering the conductor lay-in groove 14 and clearing a conductor lay-in path 40 accessible from above the connector body 12. Such an automatic alignment and positioning system is important in an environment where the electrician must control a stiff secondary electrical conductor 62 with one hand and apply torque to the pressure pad fastener 30 with the other hand.

A further aspect of the present invention is a clamshell insulating cover 50 illustrated in FIGS. 4–7. Many prior art pad mount connectors utilize a sleeve-like insulating covers, which must be installed over the connector body prior to securing the secondary conductors to the connector body. Working through small openings in the prior art insulating cover complicates the task of installing secondary conductors and verifying the quality of the electrical and mechanical connections. A clamshell insulating cover 50 in accordance with the present invention comprises hingedly connected upper and lower cover portions 52, 54.

A row of secondary conductor insulating sleeves 56 is provided along one side of the insulating cover 50. Opposite the secondary conductor sleeves 56, a hinge 58 connects the upper and lower cover portions 52, 54. Each secondary conductor sleeve 56 is split such that one half of each sleeve is carried by the upper cover portion 52 while the other half of the conductor sleeve is carried by the lower cover portion 54. A snap connection 55 is provided opposite the hinge 58 between the conductor insulating sleeves 56 (best seen in FIGS. 5 and 6).

Figure 5:
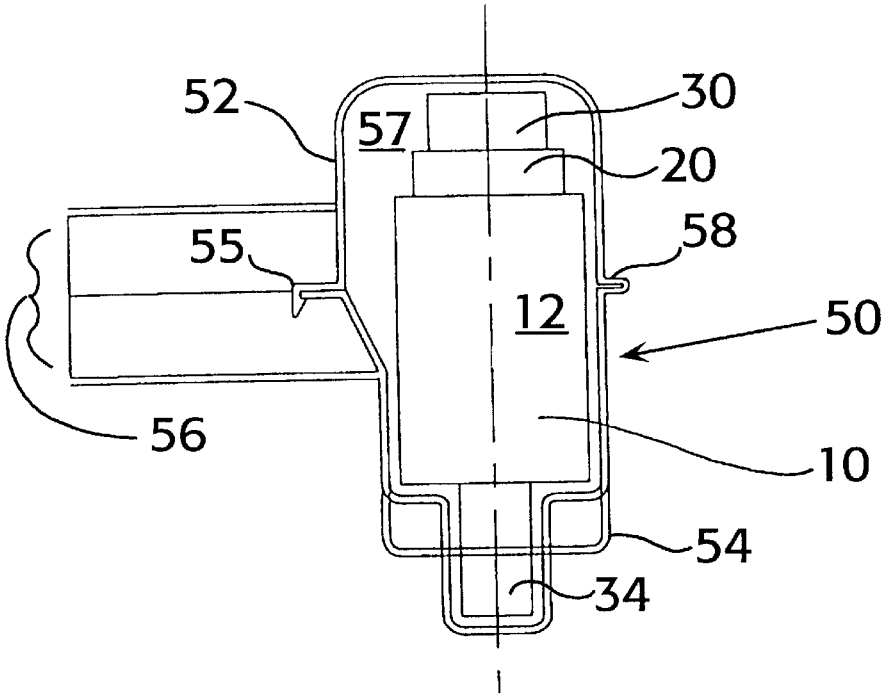
FIG. 5 is a sectional view through the top-loading pad mount connector of FIG. 1 surrounded by a clamshell insulating cover in accordance with the present invention.
Figure 6:
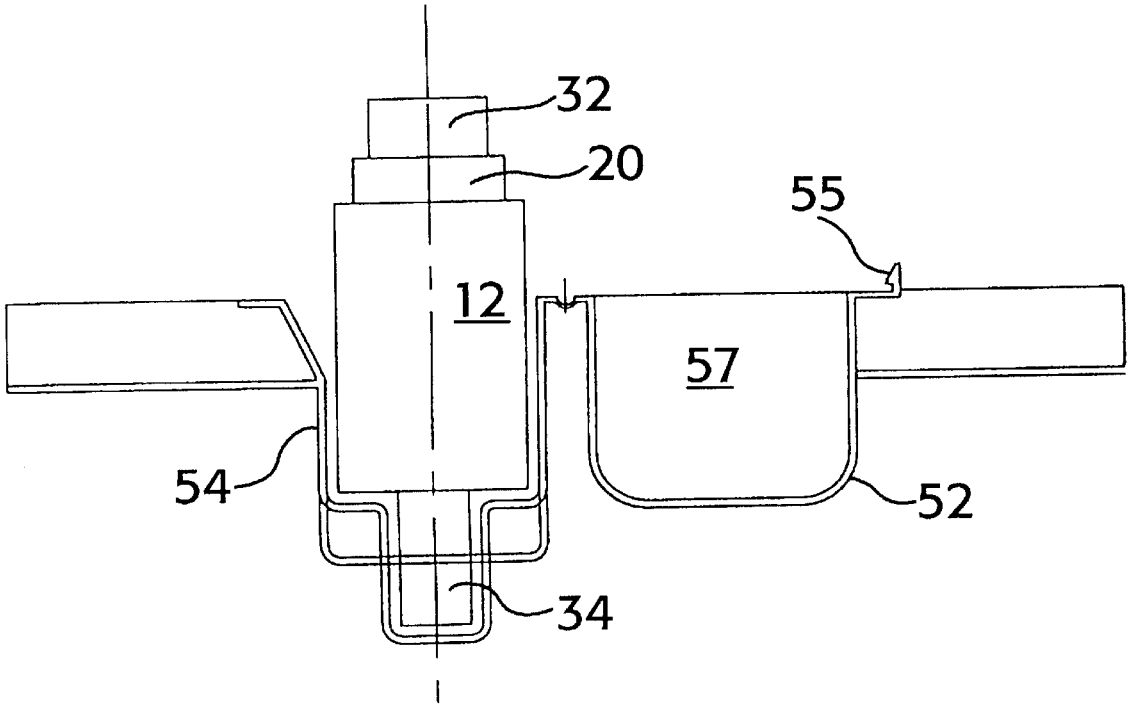
FIG. 6 is the sectional view through the top-loading pad mount connector and insulating cover of FIG. 5 with the clamshell cover opened.

After installation of the top-loading pad mount connector 10 and connection of the secondary conductors 62 has been completed and inspected, the insulating cover 50 can be snapped over the assembly to meet code requirements. FIGS. 5–7 illustrate the top-loading pad mount connector 10 surrounded by a clamshell insulating cover 50 in accordance with the present invention. The upper and lower cover portions 52, 54 define a body cavity 57. The cover 50 is provided with snap means 55 for engaging the upper cover portion 52 to the lower cover portion 54 to surround the top-loading pad mount connector 10.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An electrical connector comprising:

a longitudinally extending electrically conductive body having a longitudinal axis, a length measured along said axis, a width measured transverse to said axis and means for receiving an electrical connection;

a plurality of conductor lay-in grooves defined by said body;

a pressure pad for at least one said conductor lay-in groove; and clamping means for clamping said pressure pad to said body, said clamping means comprising a threaded fastener passing through said at least one pressure pad to engage a threaded bore in said body, said threaded bore being oriented at an oblique angle relative to said longitudinal axis, wherein said clamping means permit movement of said pressure pad relative to said body between at least a first position where said pressure pad extends over said lay-in groove and a second position where said pressure pad does not extend over said lay-in groove.

2. The electrical connector of claim 1, wherein said conductor lay-in grooves extend across the width of said body substantially perpendicular to said longitudinal axis.

3. The electrical connector of claim 1, wherein said body comprises a guide wall projecting away from said longitudinal axis adjacent at least one conductor lay-in groove, said guide wall having at least one surface extending from said at least one conductor lay-in groove.

4. The electrical connector of claim 1, wherein said at least one pressure pad and clamping means are conductive.

5. The electrical connector of claim 1, wherein said clamping means comprises a steel screw.

6. An electrical connector comprising:

an electrically conductive body defining an open-ended conductor lay-in groove;

a pressure pad movable relative to said body, said pressure pad comprising a jaw defining a clamping surface; and clamping means for clamping said pressure pad to said body, said clamping means allowing movement of said pressure pad between at least a first position wherein said clamping surface projects over and substantially parallel to said lay-in groove and a second position wherein said clamping surface is substantially perpendicular to said lay-in groove to define a substantially unobstructed conductor lay-in path is to said lay-in groove.

7. The electrical connector of claim 6, wherein said clamping means comprises a fastener and said pressure pad defines a bore substantially perpendicular to said clamping surface, said fastener passing through said bore to threadably engage said body.

8. The electrical connector of claim 7, wherein said fastener comprises a torque-receiving head and application of torque to said head to rotate said fastener in a first direction moves said pressure pad toward said body and application of torque to said head to rotate said fastener in a second direction moves said pressure pad away from said body.

9. The electrical connector of claim 8, comprising a lock washer between the fastener head and the pressure pad.

10. The electrical connector of claim 8, comprising means for transmitting a portion of the torque applied to said head to said pressure pad such that said pressure pad is rotated with said fastener over an arc toward said first position when said fastener is rotated in said first direction and toward said second position when said fastener is rotated in said second direction.

11. The electrical connector of claim 10, wherein said body comprises a pressure pad guide surface substantially parallel to said fastener, said pressure pad guide surface with said pressure pad guide surface limiting movement of said pressure pad along said arc at said first position while said fastener is permitted continued rotation in said first direction and said pressure pad guide surface limiting movement of said pressure pad along said arc at said second position while said fastener is permitted continued rotation in said second rotational direction.

12. The electrical connector of claim 11, wherein said fastener and pressure pad guide surface are oriented at an oblique angle relative to the connector body such that said conductor lay in path narrows as it approaches the lay in groove.

13. An electrical connector and cover assembly comprising:

an electrical connector comprising:

an electrically conductive body defining at least one conductor lay-in groove and means for receiving an electrical connection;

a pressure pad movable relative to said body, said pressure pad comprising a jaw defining a clamping surface; and clamping means for clamping said pressure pad to said body, said clamping means allowing movement of said pressure pad between at least a first position wherein said clamping surface projects over and substantially parallel to said lay-in groove and a second position wherein said clamping surface is substantially perpendicular to said lay-in groove to open a lay-in path above said lay-in groove; and an electrically insulating cover comprising first and second cover portions that fit together to define a body cavity with at least one conductor path in communication therewith, wherein said cover portions are connectable over said electrical connector to surround and electrically insulate said body, pressure pad and clamping means from an ambient environment.

14. The assembly of claim 13, wherein said cover comprises hinge means for flexibly connecting said first and second portions.

15. The assembly of claim 13, wherein said cover comprises latch means for maintaining a connection between said first and second portions.

16. A method of establishing a secondary electrical connection with a pad-mount transformer comprising the steps of:

laying a secondary electrical conductor into a conductor lay-in groove defined in the electrically conductive body of an electrical connector having a primary electrical connection to said transformer;

fixing the secondary electrical conductor to the body of the electrical connector to form an electrical and mechanical connection to said body, said step of fixing comprising:

applying torque to a head of a fastener having a shank passing through a fastener bore defined by a pressure pad, said pressure pad being frictionally engaged with said shank so that applying said torque to tighten said fastener rotates said pressure pad from an open position in which said pressure pad does not extend over said conductor lay-in groove to a clamping position in which said pressure pad extends over said conductor lay-in groove; and surrounding the electrical connector body and un-insulated portions of the secondary electrical conductor with an insulating cover comprising first and second cover portions that fit together to define a body cavity with at least one conductor path in communication therewith, said conductor path extending substantially parallel to said secondary electrical conductor, wherein said step of surrounding takes place after said steps of laying and fixing.

17. The method of claim 16, wherein said step of surrounding comprises closing hinged first and second cover portions over said electrical connector and secondary conductor.

18. An electrical connector comprising:

a longitudinally extending electrically conductive body having a longitudinal axis, a length measured along said axis, a width measured transverse to said axis and means for receiving an electrical connection;

a plurality of conductor lay-in grooves defined by said body;

a pressure pad for at least one said conductor lay-in groove, said pressure pad defining a bore and including a jaw laterally projecting away from said bore; and a clamp for clamping said pressure pad to said body, wherein said clamp is received in said bore and permits movement of said pressure pad relative to said body between at least a first position where said pressure pad extends over said lay-in groove and a second position where said pressure pad does not extend over said lay-in groove.

19. The electrical connector of claim 18, wherein said jaw comprises a concave clamping surface which extends over said conductor lay-in groove when said pressure pad is in said first position.

20. An electrical connector comprising:

a longitudinally extending electrically conductive body having a longitudinal axis, a length measured along said axis, a width measured transverse to said axis and means for receiving an electrical connection, said body defining a plurality of threaded bores, a plurality of conductor lay-in grooves defined by said body and a guide wall projecting away from said longitudinal axis between at least one adjacent pair of said conductor lay-in grooves and substantially parallel to each of said pair of conductor lay-in grooves, said guide wall having a conductor guide surface substantially extending from one of said pair of said conductor lay-in grooves and an axially opposed pressure pad guide surface;

a pressure pad for at least one said conductor lay-in groove, said pressure pad defining a fastener bore and including a jaw laterally projecting away from said fastener bore; and a fastener including a torque receiving head and a threaded shank, said shank passing through said fastener bore to engage said threaded bore, wherein application of torque to said head in a first rotational direction moves said at least one pressure pad to a first position aligned with and extending over said conductor lay-in groove and application of torque to said head in a second rotational direction moves said at least one pressure pad to a second position perpendicular to said conductor lay-in groove and not extending over said conductor lay-in groove.

21. The electrical connector of claim 20, comprising means for transmitting a portion of the torque applied to said head to said at least one pressure pad such that said at least one pressure pad is rotated with said fastener over an arc toward said first position when torque is applied in said first rotational direction and toward said second position when torque is applied in said second rotational direction with said pressure pad guide surface limiting movement of said at least one pressure pad along said arc at said first position while said fastener is permitted continued rotation in said first rotational direction and said pressure pad guide surface limiting movement of said at least one pressure pad along said arc at said second position while said fastener is permitted continued rotation is said second rotational direction.

22. The electrical connector of claim 20, wherein said first rotational direction corresponds to tightening said fastener and wherein said second rotational direction corresponds to loosening said fastener.

* * * * *